US007063022B1

(12) United States Patent
Marchiori et al.

(10) Patent No.: US 7,063,022 B1
(45) Date of Patent: Jun. 20, 2006

(54) TRACKSIDE RAILCAR DOOR OPENER AND CLOSER

(76) Inventors: Ralph A. Marchiori, 5914-16 Old Camp Bullis Rd., San Antonio, TX (US) 78257; Frank J. Marchiori, 7322 Stillbrook, San Antonio, TX (US) 78238

( * ) Notice: Subject to any disclaimer, the term of this patent is extended or adjusted under 35 U.S.C. 154(b) by 0 days.

(21) Appl. No.: 10/928,342

(22) Filed: Aug. 27, 2004

Related U.S. Application Data

(60) Provisional application No. 60/498,389, filed on Aug. 28, 2003.

(51) Int. Cl.
*B61D 5/00* (2006.01)
*B61D 7/00* (2006.01)

(52) U.S. Cl. ..... 105/241.2

(58) Field of Classification Search ..... 105/238.1, 105/241.1, 241.2, 286, 287, 288
See application file for complete search history.

(56) References Cited

U.S. PATENT DOCUMENTS 3,965,760 A * 6/1976 Etheredge, Jr. ..... 74/89.14
4,011,956 A * 3/1977 Green et al. ..... 414/387
4,120,412 A 10/1978 Miller et al.
4,508,037 A 4/1985 Rousseau
4,522,545 A * 6/1985 Peckham ..... 414/376
4,629,386 A * 12/1986 Tullos ..... 414/376
4,843,974 A 7/1989 Ritter et al.
5,299,508 A * 4/1994 Connelly ..... 105/241.2
5,419,262 A 5/1995 Turpin, Sr.
6,886,473 B1 * 5/2005 Marchiori et al. ..... 105/241.2
2004/0040462 A1 3/2004 Marchiori et al.

* cited by examiner

*Primary Examiner*—S. Joseph Morano
*Assistant Examiner*—Robert J. McCarry, Jr.
(74) *Attorney, Agent, or Firm*—Schmeiser, Olsen & Watts, LLP

(57) ABSTRACT

An automated and semi-automated trackside railcar door opener and closer for use with railcar doors located on or near the bottom of the railcar including a tool carriage, a controller and a support substantially parallel to a railroad track. A railcar door opener includes an alignment sensor for aligning the opening tool with a railcar door latch and a railcar door latch opener for releasing the railcar door latch. A railcar door closer includes at least two closer arms configured to close railcar doors on or near the bottom of a railcar. The opening and closing tools are each coupled to the tool carriage, and the tool carriage is moveably attached to the support. A controller controls movement and operation of the tool carriage, opening tool and closing tool.

13 Claims, 7 Drawing Sheets

TRACKSIDE RAILCAR DOOR OPENER AND CLOSER

CROSS REFERENCE TO RELATED APPLICATIONS

This application claims priority to U.S. Provisional Patent Application to Ralph A. Marchiori and Frank J. Marchiori entitled "Railcar Door Opener/Closer," Ser. No. 60/498,389, filed Aug. 28, 2003, the disclosure of which is hereby incorporated entirely herein by reference.

BACKGROUND OF THE INVENTION

1. Technical Field

This invention generally relates to an apparatus for opening and closing of railroad car doors, and more specifically to an apparatus for automatically or semi-automatically opening and closing rapid discharge railcar doors located on or near the bottom of a railcar.

2. State of the Art

A common type of railroad freight car used today is an open-top hopper car wherein the commodity carried by the railcar is discharged through an opening provided on the underside of the car. Such cars are used to haul aggregate, iron ore, coal and other commodities. Such cars offer an advantageously economical method of transporting large amounts of a commodity between locations.

Such railroad cars generally include a walled enclosure or hopper carried by an under frame of the car. On some hopper cars, the under frame includes a longitudinally elongated center sill or support which is supported, toward its opposing ends, by the usual wheeled trucks that ride on tracks or rails. Although the design of the bottom side of the railcar hopper varies considerably, the hopper is typically provided with a plurality of generally funnel shaped discharge openings which extend either parallel to the longitudinal axis of the car (longitudinal openings) or are disposed in pairs on opposite lateral sides of the longitudinal axis of the car (transverse openings). Each type of hopper serves a particular need in the railcar industry.

Conventionally, when a hopper car arrives to deliver its load, technicians open its doors. The conventional way to open the door is by striking the railcar door latch in an upward direction with a large sledgehammer. The striking motion required has to be accurate for the latch to move to the open position. Often, it takes multiple strikes of a hammer for the latch to release, allowing the doors to open and dispatch the material into the hopper below.

The technician opening the door in this conventional way is exposed to many hazards. The surface he is standing on, through which the transported commodity falls, is generally a grate of various dimensions of spacing; an estimated average is an opening of approximately six inches square. The grate is necessary for the material to flow through to a hopper located under the grate. The grate creates a hazard for the technician, and the industry has experienced an unacceptably large number of accidents related to human extremities slipping through the grate while technicians open the doors. Additionally, missing the latch while attempting to deliver the powerful strike required to move the latch can result in the technicians loosing their balance, falling and sustaining various types of injuries.

To close the doors the technician again stands on the grate through which the material flows. While on this grate, the technician is required to use a heavy steel bar, which is inserted into the hopper door, and then pried up to the latch of the railcar door latch. When the hopper doors are bent or out of square, which is common due to the fact that the doors are generally opened one side at a time causing torsional stresses on the door from the weight of the commodity above the door, the technician is then required to force the doors closed in anyway possible. This action while standing on the grate creates a hazard for the technicians, and the industry has experienced an unacceptably large number of accidents related to human extremities falling through this grate while technicians close the doors too. Many injuries to the back are also sustained.

U.S. Pat. No. 4,508,037 to Rousseau describes a car door opener for use on a railway hopper car with several rapid discharge bottom dump doors. In Rousseau, the doors are operated by a main door-operating member in the form of a truss bar running the length of the car. Moving of the bar rotates levers; the rotation of the levers rotates actuator shafts; the rotation of the actuator shafts move the door operating linkage arrangements resulting in opening and closing of the dump doors.

U.S. Pat. No. 4,843,974 to Ritter describes a car door opener for use on a railroad hopper car having bottom discharge doors. In Ritter, an elongated beam assembly along the bottom of the car, door operating levers to open and close the doors connected to the beam assembly and doors, and lost motion timing connections in the beam assembly which permits displacement of beam sections to open and close pairs or sets of doors in a sequential but substantially simultaneous and automatic order so as to permit reduction of air pressure required to open the doors, or permit use of smaller diameter air cylinder.

U.S. Pat. No. 5,419,262 to Turpin describes a closer. In Turpin, the hopper car doors including a supporting frame structure associated with the rails on which a series of hopper cars are rolling supported together with power actuated devices that will pivot the hopper car doors from a generally vertical, downwardly extending open position which exists after the hopper car has been unloaded for engaging the hopper car doors and pivoting them about their transversely extending supporting axis to a closed, latched position. The power devices include transversally extending support shafts with a pair of laterally extending rigid arms, with each arm including a wheel at its outer end for engaging the hopper car doors when the transverse shafts are pivoted.

U.S. Pat. No. 5,299,508 to Connelly describes a railroad car door closure having trackside mounted plural actuating arms. In Connelly, a closer for closing the doors of a railroad hopper car has two closer assemblies. The assemblies are mounted adjacent to each rail of a track on a frame, which passes below and between the rails. Each assembly includes a hydraulic closer jack, a hydraulic lifting jack and a hydraulic swing motor for orienting the closer jack related to a door. The jack is extendable to contact a door and push it to a closed position. The jack assemblies can be pivoted 180 degrees by the swing motor to close the door of the forward car and then rearward car without having to reposition the train.

U.S. Pat. No. 4,120,412 to Miller describes a trackside door closing arrangement for railway hopper cars. In Miller, a trackside door closing the swinging doors of a railway hopper car includes a pair of pneumatic tires and wheels mounted on a pivot arm. The tires are interconnected for rotation in concert and during engagement with the doors swing them inwardly to a closed position.

U.S. Pat. No. 4,011,956 to Green describes a closure mechanism for bottom dump hopper cars. In Green, a side of track closure mechanism is provided for engaging and exerting an inward direction lateral thrust against bottom dump doors of a hopper car for hingedly moving the doors inwardly directed lateral thrust against the doors moving the doors to a closed position. The actuating mechanism includes a rotating arm having actuating apparatus at one end which when placed in an index position is adapted to engage the doors of bottom dump hopper cars as they move along a track adjacent to which the closure mechanism is positioned.

DISCLOSURE OF THE INVENTION

The present invention relates to a device for opening and closing railcar doors wherein the doors are located on or near the bottom of the railcar. This invention will provide an automated and/or semi-automated door opener and closer for railcar doors. The opening and closing tools are coupled to one or more tool carriages, which are moveably attached to a support running substantially parallel to the railroad track.

The tool carriage traverses a portion of the support so as to roughly align the tools with the proper railcar door to be opened or closed. The opening tool may then be extended and an alignment sensor finely and properly aligns the opening tool with the railcar door latch. Once aligned, the opening tool uses a railcar door latch opener to release the latch, allowing the commodity within the railcar to discharge through the railcar door. Once the railcar door latch has been released, the opening tool retracts from the railcar door. After the commodity has been completely discharged, the closing tool may then move closer arms from a position not in contact with the railcar doors to a position wherein the arms are in contact with the railcar doors and provide sufficient force to close the doors and engage the railcar door latch. When the doors are closed, the closer arms are moved back to a position not in contact with the railcar doors and clear of interference with the railcar if the railcar is moved.

Opening and closing tools may be postured on both sides of the railroad track on which the railcar sits, to open and close railcar doors from both sides. This is a significant advantage in protecting the doors from damage because both sides of a hopper door can be opened and closed simultaneously.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a device for opening and closing railcar doors wherein the doors are located on or near the bottom of the railcar. The railcar door opening and/or closing tools of the present invention may be coupled to a tool carriage, which is moveably attached to a support for traversing the tools along a portion of the support substantially parallel to the railroad track on which the railcar sits.

Figure 1:
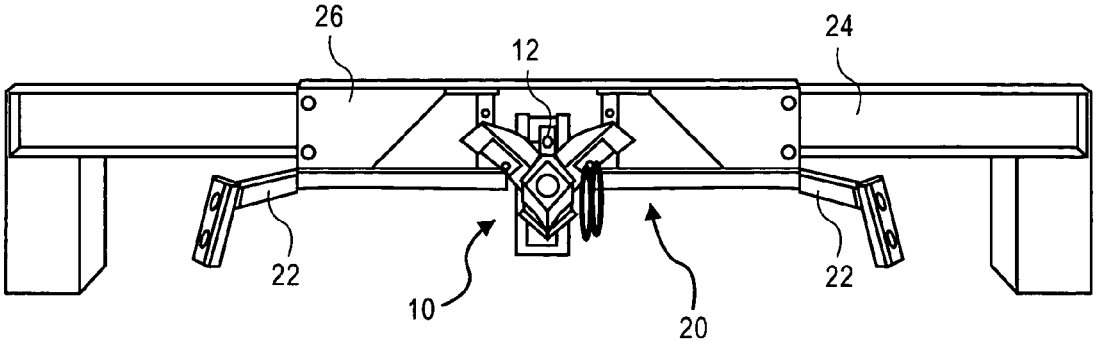
FIG. 1 is a front view of an opening and closing tool.
Figure 2:
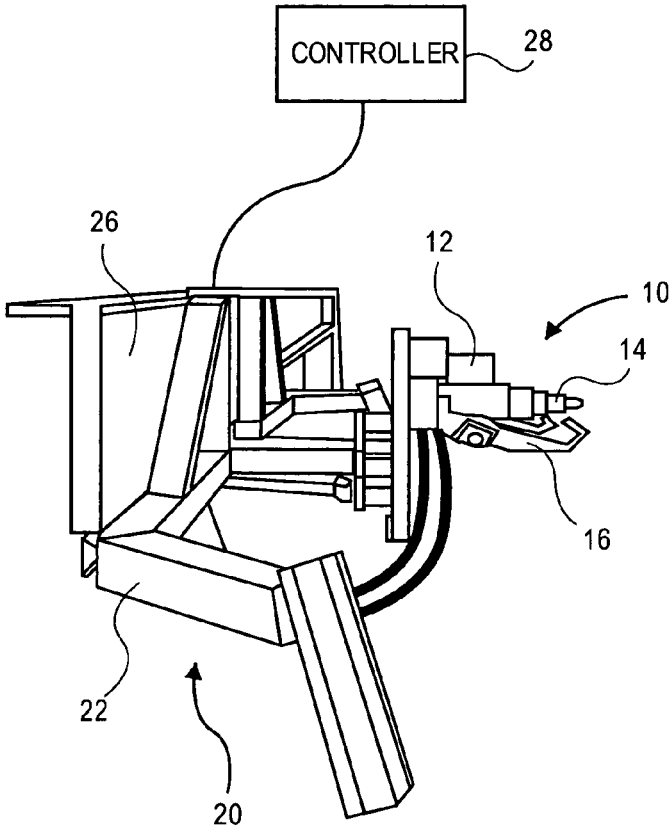
FIG. 2 is a side perspective view of an opening tool and a closing tool.

As shown in FIGS. 1 and 2, a particular embodiment of an opening tool 10 includes a nose 14, at least one railcar door latch opener 16 and a sensor 12. A particular embodiment of a closing tool 20 includes at least two closer arms 22. Each the opening tool 10 and the closing tool 20 may be coupled to one or more tool carriages 26. The tool carriage 26 is moveably coupled to a support 24, thereby allowing the tool carriage to traverse along a portion of the support. A controller 28 is electronically connected to each of the opening tool 10, the closing tool 20 and the tool carriage 26. The controller 28 may be semi-automated to control the movement of each the opening tool 10, the closing tool 20 and the tool carriage 26, wherein an operator may interface with the controller 28 and provide certain commands to cause desired actions by the opening tool 10, closing tool 20 and tool carriage 26. However, it will be understood by those of ordinary skill in the art that with certain additional sensors provided to the system, the controller 28 may be fully automated to open and close railcar doors without the need for human monitoring and input.

Figure 3:
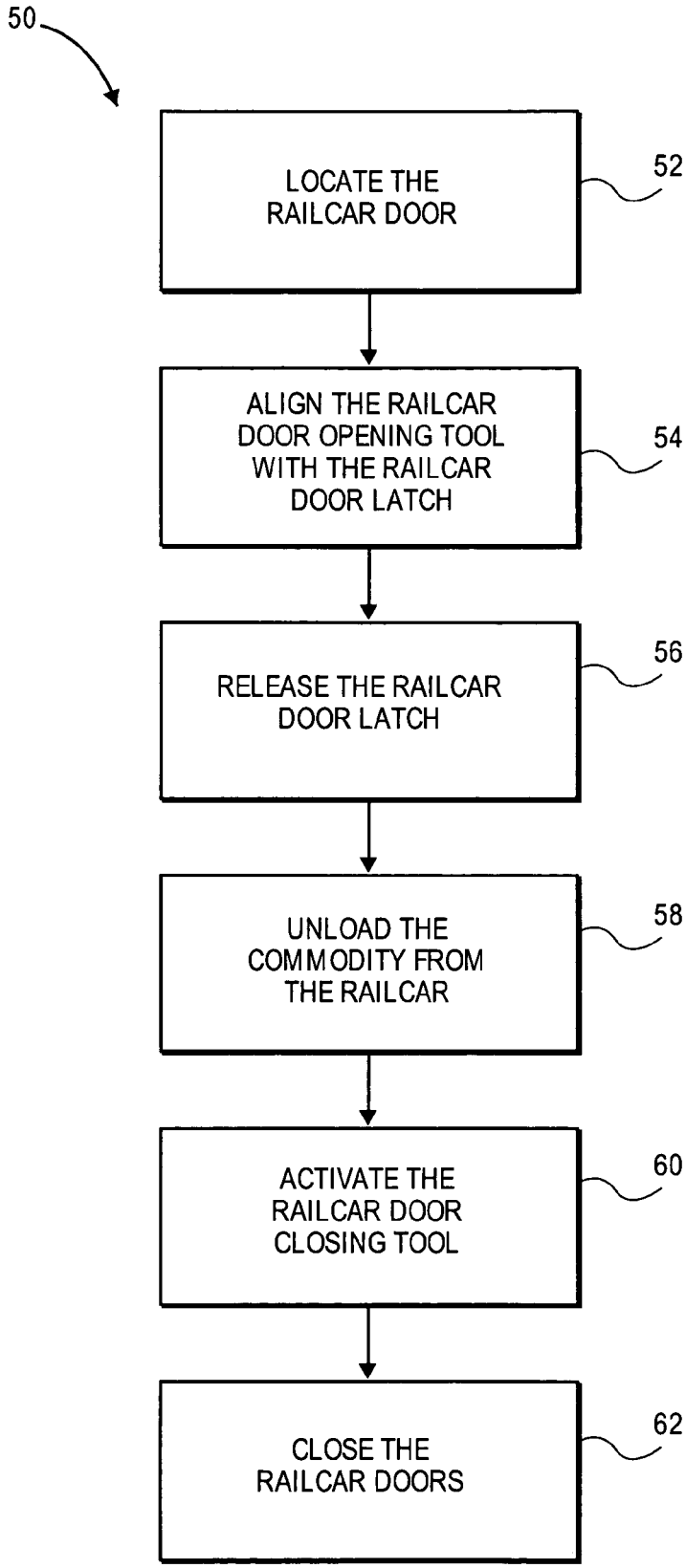
FIG. 3 is a flow diagram of a method of opening and closing a railcar door according to an embodiment of the present invention.

FIG. 3 is flow diagram showing a method of opening and closing a railcar door according to an embodiment of the present invention for use with rapid discharge doors located on the bottom of the railcar larches with a wine door latch. As a railcar comes into an unloading area, the railcar stops on a portion of the railroad tack designated for unloading a transported commodity. Opening and closing method 50 is then used to unload the commodity.

Figure 4:
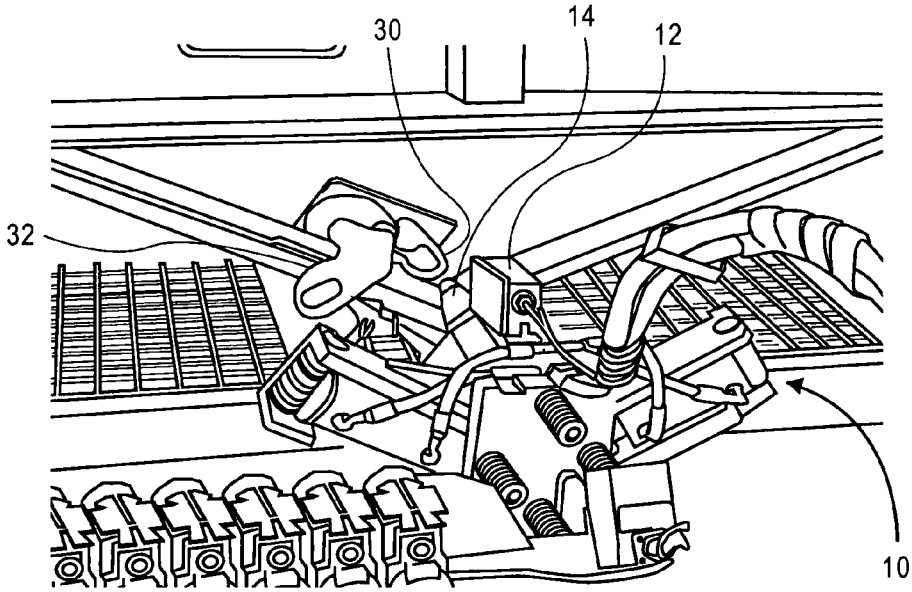
FIG. 4 is a perspective view of an opening tool using a sensor for alignment with a railcar door latch.

For the exemplary purposes of this embodiment, opening and closing method 50 is accomplished by first using tool carriage 26 to locate the railcar door (Step 52) and roughly align the opening tool with it. In this semi-automated example, the railcar door is located by the operator entering a command in the controller 28 communicating with the tool carriage 26 to cause the tool carriage 26 to move into a roughly aligned position with the railcar door as seen in FIGS. 2 and 4. For particular embodiments of the invention, the controller 28 may include directional controls through which the operator may cause the tool carriage 26 to traverse the support 24 to the desired position selected by the operator or to a pre-assigned station corresponding to a set of doors on the railcar.

Next, the railcar door opening tool 10 is aligned with the rail car door latch (Step 54). To accomplish this, and referring to FIGS. 4 and 7, the operator gives the opening tool 10 a command to self-align. Opening tool 10 may then utilize alignment sensor 12 to locate the door lock bracket 30 associated with the lock railcar door latch 32. In this particular embodiment of the invention, a laser sensor 12 is used. Once the door lock bracket 30 is located, the sensor aligns the nose 14 of the opening tool 10 with a loop of the door lock bracket 30, such that the nose 14 may be inserted into the door lock bracket 30. It will be understood that alignment of the opening tool 10 with the door lock may be accomplished through sensing another portion of the railcar in a known position relative to the door lock and aligning by reference to the known relative position. For example, the laser sensor 12 of this embodiment could be programmed to sense the latch itself or some other known portion of the railcar and then calculate the distance to the latch from that known railcar part.

Figure 5A:
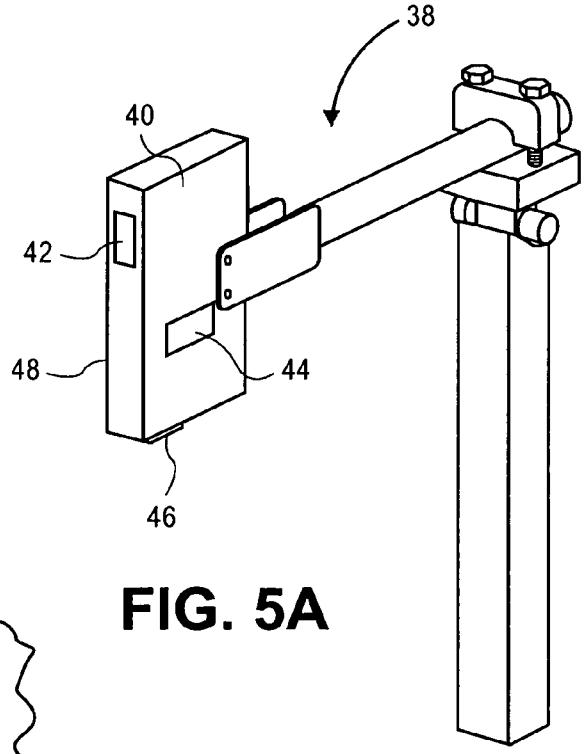
FIG. 5 is a perspective view of an alternative sensor for use with embodiments of the present invention.
Figure 5B:
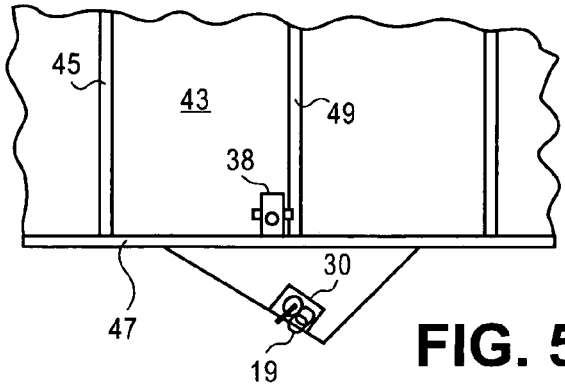
Figure 6:
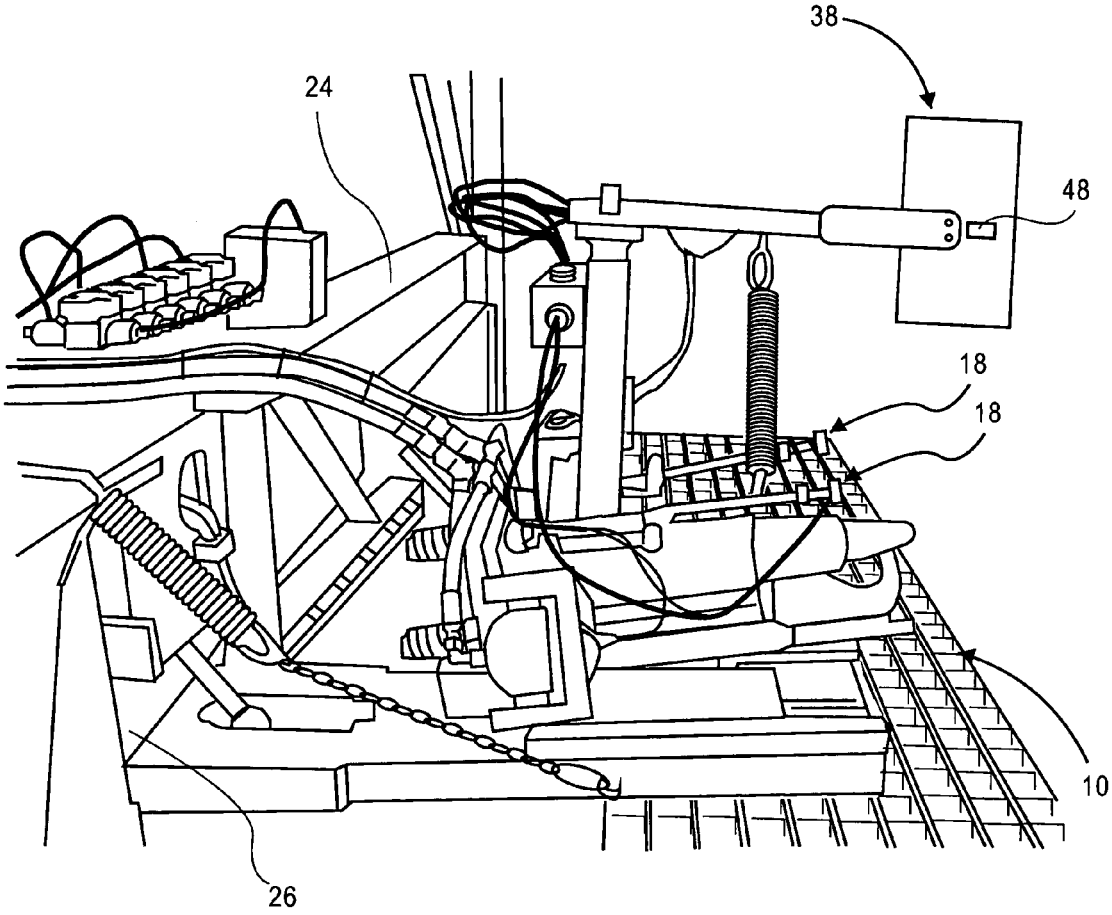
FIG. 6 is a side view of an opening tool with the alternative sensor attached to it according to an embodiment of the present invention.

It will be understood those of ordinary skill in the art that the sensor 12 may be any other type of sensor that allows the opening tool 10 to automatically align with the railcar door latch in a functional manner. For example and according to FIGS. 5*a* and 5*b*, a manual sensor 38 may be used instead of a laser sensor. Manual sensors such as sensor 38 may even be preferred in some cases because a physical reading may be obtained and may simplify accurate alignment. The sensor 38 of this example includes a spacer 40 for retaining sensors and spacing them from each other, a wall sensor 42, a left bolster sensor 44, a bottom plate sensor 46 and a right bolster sensor 48 (on backside of spacer 40 in FIG. 5*a*). Each sensor is retained by spacer 40. The sensors 42, 44, 46 and 48 work in conjunction with each other to locate relative positions with respect to known reference points on the railcar. Some of the reference points that may be used include, but are not limited to, the railcar wall 43, the bolsters 45 and 49, and the bottom lip plate 47. The sensors detect a certain distance from each respective reference point, each sensor working independently from the others and working either simultaneously or in series with the other sensors. Each sensor measurement causes the controller to adjust the position of the opening tool 10 until the each sensor has detected a predetermined distance from each reference point that the particular sensor was intended to detect. Once these predetermined distances are detected, the opening tool 10 is considered to be aligned, and the nose 14 may be inserted into the loop of door lock bracket 30. Additionally, before the railcar door latch 32 can be released, a cam lock 19 that locks the latch 32 must be released. Release of the cam lock 19 may be accomplished by an operator or automatically by a portion of the opening tool 10. In embodiments where the cam lock 19 is manually opened by an operator, cam lock sensors 18 are used to detect whether the cam lock 19 has been released. For this embodiment, the cam lock sensor 18 determines if there is metal directly in front of the properly aligned sensor 18. If the cam lock sensor 18 does not detect metal it is determined that the cam lock 19 is still engaged and the opening tool 10 will retract automatically to allow the operator to manually release the cam lock before proceeding to release the railcar door latch 32. In embodiments where the cam lock 19 is automatically opened by the door opener 10, when metal is not detected directly in front of the sensor 18, a moveable arm (not shown) actuates the cam lock 19 to open it.

For the exemplary purposes of this disclosure, spacer 40 for retaining sensors may be made of a polyethylene such as, but not limited to, ultra high molecular weight polyethylene. The sensors 42, 44, 46, and 48 may be magnetic sensors, but are not limited to magnetic sensors and may be of any type of sensor known in the art to perform relative positional detection.

Figure 7:
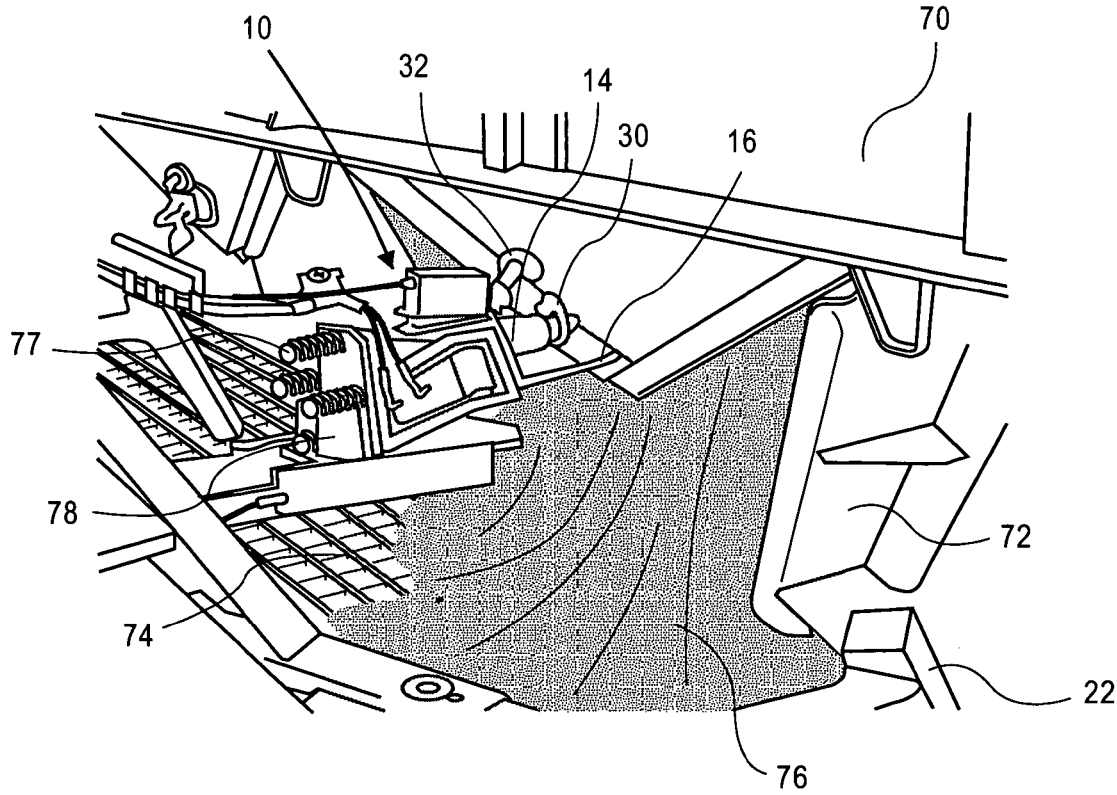
FIG. 7 is a perspective view of an opening tool opening a railcar door.

After the railcar door opening tool is aligned with the railcar door latch, the railcar door opener releases the railcar door latch (Step 56), causing the railcar doors to open under the force of the cargo within the railcar. The commodity within the railcar then unloads (Step 58). To release the railcar door latch 32, the nose 14 is inserted into the hole of the door lock bracket 30 and one or more railcar door latch openers 16, which are moveably extendable from the opening tool 10, are forcibly moved to engage the railcar door latch and release the latch as shown in FIG. 7. Once the railcar door latch 32 has been released, the commodity 76 is gravitationally discharged, forcing open the railcar doors 72 located on the bottom of the railcar. The commodity 76 is discharged to a hopper (not shown) located underneath grate 74.

The opening tool 10 is coupled to the tool carriage 26 through plate 78 by use of spring-loaded fasteners 77. The spring-loaded fasteners 77 permit the opening tool 10 to flex to avoid binding of the opening tool 10 if the railcar 70 should rise with the discharge of the massive weight of the commodity being transported. It will be understood by those of ordinary skill in the art that the railcar door latch openers 16 shown in the present embodiment are configured to open a railcar door latch 32 on the right side, the left side or on both sides, requiring only a single action to release the latch or latches. It will also be understood that forcible movement of railcar door openers 16 may be accomplished by use of hydraulics, actuators, gears or any other manner of movement, alone or in combination, such that sufficient force to close the railcar doors is generated. The embodiment shown in the relevant figures operates using hydraulics. Also, the railcar door opening tool 10 of the present invention may be configured to open railcar door latches 32 of a variety of different styles and configurations. Particular embodiments of the present invention shown in the attached figures are particularly useful for releasing a Wine door latch common on rapid discharge railcar doors.

Figure 8:
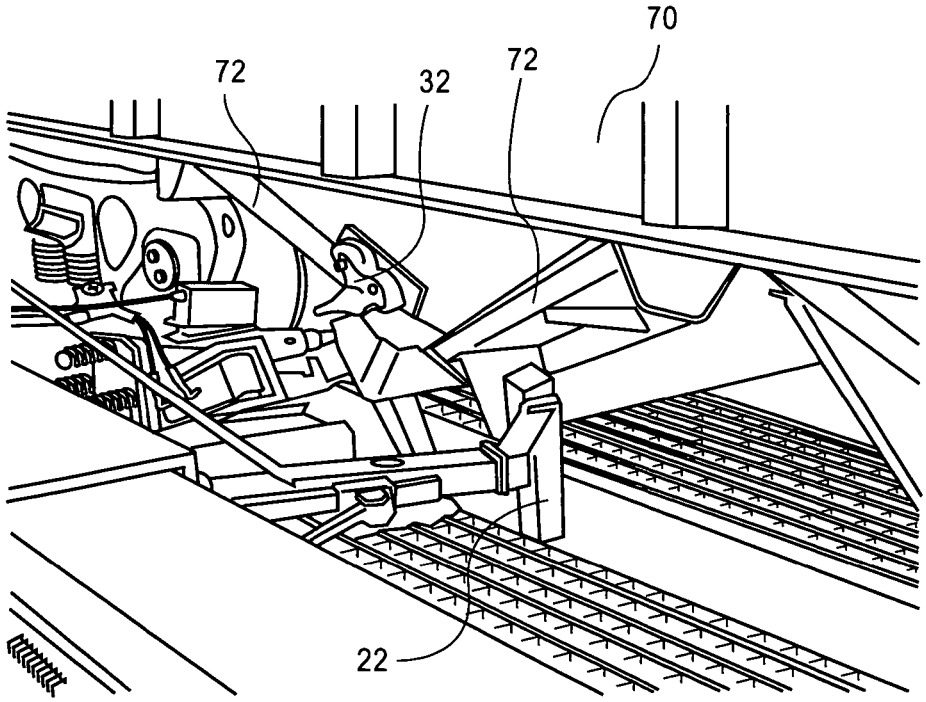
FIG. 8 is a perspective view of a closing tool closing a railcar door.

Once the commodity is unloaded from the railcar (step 58), the railcar door closing tool may be activated (Step 60). Railcar door closing may occur immediately after the railcar is unloaded, in which case the embodiments shown in the attached figures combining the opening tool 10 and the closing tool 20 on the same tool carriage 26 will generally not need to be re-aligned prior to closing the railcar doors. If necessary, however, or if the closing tool 20 was not previously aligned with the railcar doors 72, the same alignment methods previously used to align opening tool 10 may be used to align the closing tool 20. After the closing tool 20 is aligned, the tool carriage 26 is maintained in a stationary position while the railcar doors are closed. Referring to FIGS. 7 and 8, activation of the closing tool 20 creates a movement of closer arms 22 from a position where the closer arms 22 are not in contact with the railcar door and are preferably clear from interfering with movement of the railcar, to a position where they are in contact with the railcar doors 72. When the closer arms 22 are in contact with the railcar doors 72, the final step to close the rail car doors (Step 62) may be accomplished. Through the controller, the closer arms 22 are caused to apply sufficient force against the railcar doors 72 to close them and engage the railcar door latch 32, completing the unloading of the railcar 70. In the particular examples shown in the attached figures, the closer arms 22 pivot substantially horizontal to the ground to close the railcar doors. It will be understood by those of ordinary skill in the art, however, that the arms may pivot at other angles to the ground, or may operate to push the doors closed by some other linear or curvilinear force.

It will further be understood by those of ordinary skill in the art that the closer arms 22 may operate together or independently from each other. They may also operate simultaneously or separately to close railcar doors 72, depending upon the style of the railcar doors 72 used on a particular railcar. For example, rail car doors 72 may be door-on-door reinforcement style doors, wherein one door is closed and the other door is closed on top of it providing reinforcement to the first door, and the railcar door latch is only attached to the door providing the reinforcement. With this style of door, the timing used for the closer arms 22 may be set so that the reinforced door is closed before the door providing the reinforcement to engage the door latch 32, thereby closing the doors.

Figure 9:
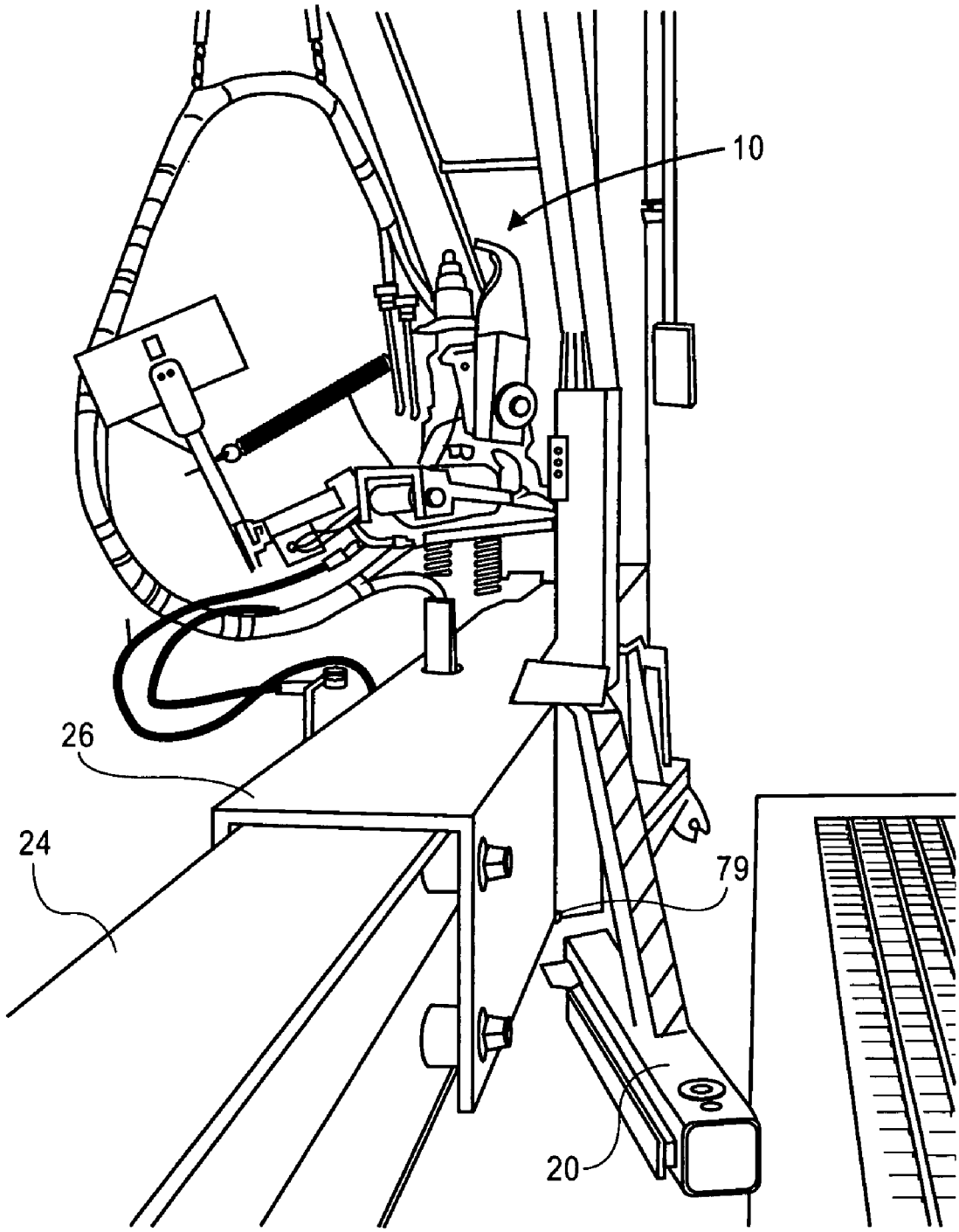
FIG. 9 is a view of an opening and closing tool in a raised position clear from the path of a railcar on the railroad track.

All or a portion of the opening tool 10 and/or closing tool 20 may be hingedly attached to the tool carriage 26 as seen in FIG. 9, through one or more hinges 79. The hingedly attached components may be raised to a parked or non-use position. In the particular example shown in FIG. 9, the opening tool 10 is hingedly attached to the tool carriage 26 and folded up against the tool carriage 26 so that the opening tool 10 is above the tool carriage 26 and the support 24. The closing tool 20 shown in FIG. 9 is also in a retracted position. It will be understood by those of ordinary skill in the art that the closer arms 22 may be integral parts of the closing tool 20 or they may be removable, foldable and/or telescoping to provide more clearance for railcars to pass the closing tool 20 so as to abide by clearance specifications.

Figure 10:
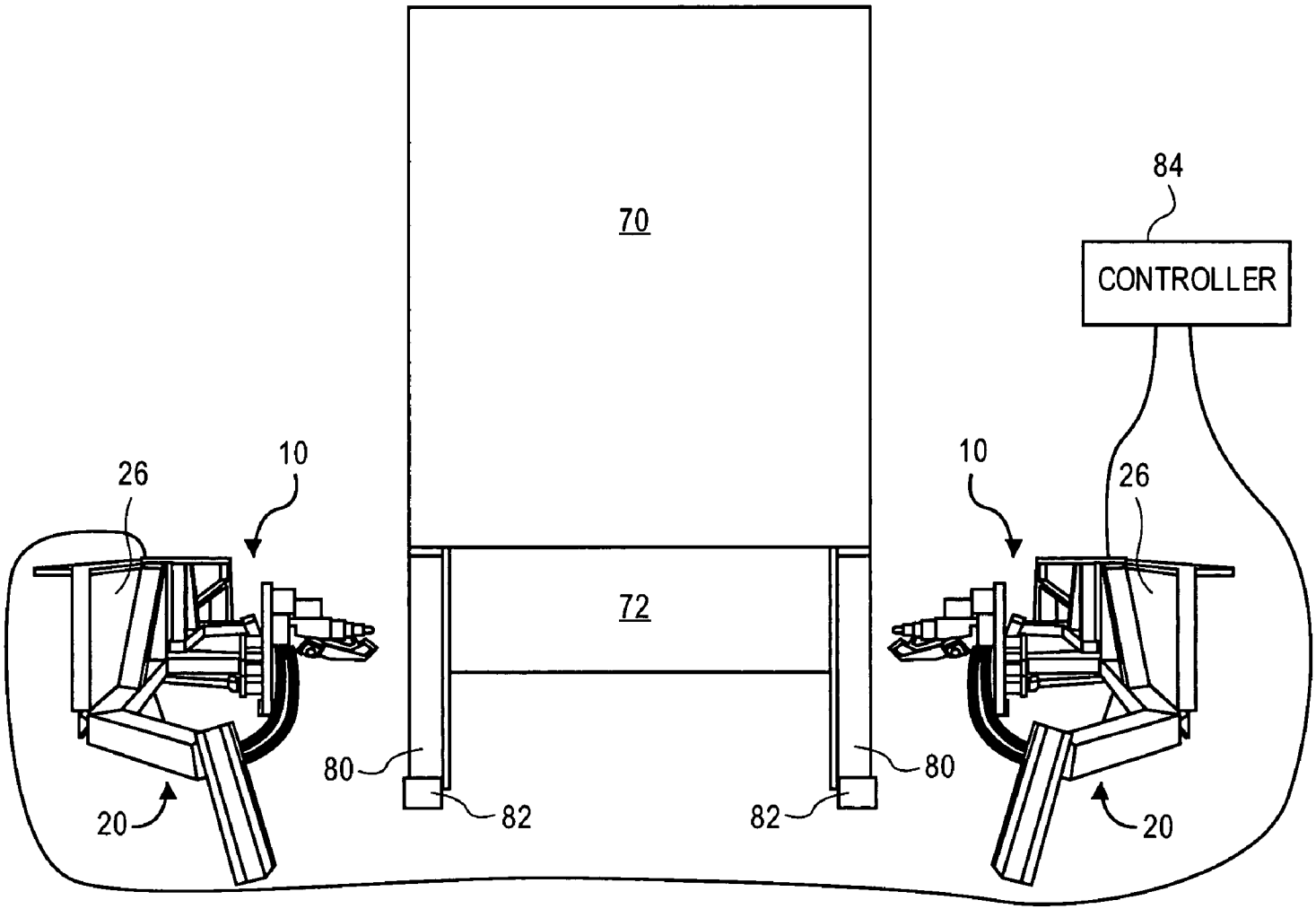
FIG. 10 is a front view of a railcar and two opening and two closing tools located on opposing sides of the railcar according to an embodiment of the invention.

FIG. 10 shows the use of two opening and closing tools, one on each side of a railcar. The opening and closing tools are railcar door operating tools. A railcar door operating tool may be controlled by a single controller 84, or may be controlled by multiple controllers 84. The tool carriages 26 may traverse along their respective supports substantially parallel to the side of railcar 70. They may each align with the respective sides of the railcar doors 72 and have clearance from contacting railcar wheels 80 and railroad track 82 while traversing. In one particular embodiment, one user may operate both sets of tools using a single controller 84, wherein the tools are functioning substantially simultaneously. When using one controller 84, each opening tool 10 may communicate to the controller 84 that each has established proper alignment before the controller 84 will allow the releasing of the door latches. Additionally alignment for both closing tools 20 may be confirmed before closer arms 22 are moved to close the railcar doors. Because of the significant potential for equipment damage caused by door latches on opposing sides of the railcar being opened at different times, the damage being caused by the weight of the railcar load pressing against the unlatched side of the door, embodiments that open both latches simultaneously are particularly advantageous. While it has been disclosed that a single user operating a single controller may control both sets of tools, those of ordinary skill in the art will readily understand that two users can operate separate controllers, one for each set of tools.

The embodiments and examples set forth herein were presented in order to best explain the present invention, its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above and knowledge available to those of ordinary skill in the relevant art without departing from the spirit and scope of the forthcoming claims. For example, the tool carriage may be traversed along a portion of the support by use of a motor and chain, cable or belt. The opening tool and the closing tool may each be coupled to the same tool carriage, or in other particular embodiments may be on separate tool carriages and operated by separate or associated controllers. Additionally, the controller may be associated with a computer that issues commands or the controller may be associated with a type of control stick for controlling the direction of movement of the tool carriage and buttons that when depressed initiate automated or semi-automated processes.

The invention claimed is:

1. A trackside railcar door opener for a railcar door latch, the railcar door opener comprising:

an elongated railcar door opener support substantially parallel to and extending along a railroad track;

a tool carriage movably mounted on the support and configured to move along at least a portion of the support;

a railcar door opening tool mounted on the tool carriage, the railcar door opening tool comprising:

an opener alignment tool having at least one sensor configured to sense a position of a portion of the railcar in relation to the railcar door opening tool; and at least one railcar door latch opener moveably extending from the opening tool and configured to release the railcar door latch, wherein the railcar door opening tool is pivotally mounted on the tool carriage, the railcar door opening tool having a lowered position in which the railcar door opening tool opens the railcar door latch, and a raised position in which the railcar door opening tool is clear of interference with a moving railcar on the tracks; and at least one controller operatively associated with the tool carriage and the railcar door opening tool, the at least one controller configured to cause the railcar door opening tool to move into alignment with and release the railcar door latch.

2. The trackside railcar door opener according to claim 1, further comprising:

a second elongated railcar door opener support substantially parallel to and extending along a second side of the railroad track;

a second tool carriage movably mounted on the second support and configured to move along at least a portion of the second support; and a second railcar door opening tool mounted on the second tool carriage, the second railcar door opening tool comprising:

a second opener alignment tool having at least a second sensor configured to sense a position of a portion of the railcar in relation to the second railcar door opening tool; and at least a second railcar door latch opener moveably extending from the second opening tool and configured to release the second railcar door latch.

3. The trackside railcar door opener according to claim 2, wherein the at least one controller operatively associated with the tool carriage and the railcar door opening tool, is also operatively associated with the second tool carriage and the second railcar door opening tool, and wherein the at least one controller is further configured to cause the second railcar door opening tool to move into alignment with and release the second railcar door latch while causing the railcar door opening tool to move into alignment with and release the railcar door latch.

4. The trackside railcar door opener according to claim 2, wherein the controller is also operatively associated with the second railcar door opening tool and is configured to cause the railcar door latch opener and the second railcar door latch opener to open the respective railcar door latch and second railcar door latch at substantially the same time.

5. The trackside railcar door opener according to claim 1, wherein the railcar door is a rapid discharge railcar door and the railcar door latch is a wine door latch.

6. The trackside railcar door opener according to claim 1, wherein the at least one railcar door latch opener comprises a first railcar door latch opener configured to open the railcar door latch when the latch is on a first side of the alignment tool, and a second railcar door latch opener configured to open the railcar door latch when the latch is on a second side of the alignment tool.

7. The trackside railcar door opener according to claim 1, wherein the opener alignment tool and controller work together to align the railcar door latch opener with the railcar door latch when the tool carriage is moved adjacent to the railcar door.

8. The trackside railcar door opener according to claim 1, wherein the railcar door opening tool is movably mounted on the tool carriage and is moveable between a retracted position nearer the tool carriage, and an extended position nearer the railcar door latch.

9. The trackside railcar door opener according to claim 1, further comprising a railcar door closing tool mounted on the tool carriage, the railcar door closing tool comprising at least two closer arms extending from the tool carriage, the closer arms movable from a first position wherein the closer arms are each in contact with at least one railcar door to a second position in which none of the closer arms are in contact with any railcar door.

10. The trackside railcar door opener according to claim 9, wherein the at least two closer arms are configured such that a first closer arm is configured to close a first railcar door prior to a second closer arm closing a second railcar door.

11. The trackside railcar door opener according to claim 9, wherein the closer arms are independently moveable.

12. The trackside railcar door opener according to claim 9, wherein the closer arms pivotally move substantially horizontal to the track.

13. A trackside railcar door opener for a railcar door latch the railcar door opener comprising:

an elongated railcar door opener support substantially parallel to and extending along a railroad track;

a tool carriage movably mounted on the support and configured to move along at least a portion of the support;

a railcar door opening tool mounted on the tool carriage, the railcar door opening tool further comprising:

an opener alignment tool having at least one sensor configured to sense a position of a portion of the railcar in relation to the railcar door opening tool; and at least one railcar door latch opener moveably extending from the opening tool and configured to release the railcar door latch;

at least one controller operatively associated with the tool carriage and the railcar door opening tool, the at least one controller configured to cause the railcar door opening tool to move into alignment with and release the railcar door latch; and a sensor associated with the railcar door latch opener and configured to sense whether a cam lock portion of the door latch has been opened and to prevent the railcar door latch opener from attempting to open the door latch if the cam lock portion of the door latch has not been opened.

* * * * *